US009486078B2

(12) United States Patent
Mobley et al.

(10) Patent No.: US 9,486,078 B2
(45) Date of Patent: Nov. 8, 2016

(54) SHELF ASSEMBLY

(71) Applicant: Electrolux Home Products, Inc., Charlotte, NC (US)

(72) Inventors: Benjamin Mobley, Iva, SC (US); Cory Dale Simpson, Abbeville, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 14/994,237

(22) Filed: Jan. 13, 2016

(65) Prior Publication Data

US 2016/0174710 A1 Jun. 23, 2016

Related U.S. Application Data

(62) Division of application No. 14/577,233, filed on Dec. 19, 2014, now Pat. No. 9,259,088.

(51) Int. Cl.
*A47B 96/02* (2006.01)
*F25D 25/02* (2006.01)

(52) U.S. Cl.
CPC ..... *A47B 96/024* (2013.01); *A47B 96/021* (2013.01); *F25D 25/02* (2013.01)

(58) Field of Classification Search
CPC A47B 96/027; A47B 96/062; A47B 96/024; A47B 96/025; A47B 96/028; A47B 96/021; A47B 96/02; F25D 25/02; F25D 25/024
USPC ..... 211/186, 90.01, 90.02, 153; 312/408, 312/407, 401
See application file for complete search history.

(56) References Cited

U.S. PATENT DOCUMENTS

| | | | |
|---|---|---|---|
| 3,912,085 | A | 10/1975 | Cooke et al. |
| 5,332,611 | A | 7/1994 | Shanok et al. |
| 5,362,145 | A | 11/1994 | Bird et al. |
| 5,429,433 | A | 7/1995 | Bird et al. |
| 5,641,217 | A | 6/1997 | Caruso et al. |
| 6,422,673 | B1 | 7/2002 | Bienick |
| 6,488,347 | B1 | 12/2002 | Bienick |
| 6,679,573 | B2 | 1/2004 | Bienick |

(Continued)

FOREIGN PATENT DOCUMENTS

| | | |
|---|---|---|
| DE | 9406171 | 8/1995 |
| EP | 2549212 | 1/2013 |
| FR | 2 955 911 A1 | 8/2011 |

OTHER PUBLICATIONS

International Search Report and Written Opinion of Corresponding Application No. PCT/US2015/063146; Dated Mar. 10, 2016.

*Primary Examiner* — Babajide Demuren
(74) *Attorney, Agent, or Firm* — Pearne & Gordon LLP

(57) ABSTRACT

A shelf assembly for an appliance comprises a shelf panel with a planar support surface and a frame to support the shelf panel with the support surface extending generally along a horizontal plane. The frame comprises a front support channel, opposed side support channels, and a rear support channel. The rear support channel is adapted to support the shelf panel against the force of gravity and to inhibit removal of the shelf panel from the frame in the direction of the horizontal plane. The shelf panel is selectively insertable into or removable from the rear support channel by temporarily deflecting the rear support channel relative to the horizontal plane a sufficient amount to separate the rear support channel from a rear edge of the shelf panel.

18 Claims, 10 Drawing Sheets

(56) References Cited

U.S. PATENT DOCUMENTS

| | | | |
|---|---|---|---|
| 7,147,293 | B2 | 12/2006 | Bienick et al. |
| 7,237,856 | B2 | 7/2007 | Bienick et al. |
| 7,562,630 | B2 | 7/2009 | Lee et al. |
| 7,748,804 | B2 | 7/2010 | Lim et al. |
| 8,287,062 | B2 | 10/2012 | Nash et al. |
| 8,403,437 | B2 | 3/2013 | Bergmann et al. |
| 8,480,194 | B2 | 7/2013 | Leconte et al. |
| 8,534,783 | B2 | 9/2013 | Nash et al. |
| 2004/0195945 | A1 | 10/2004 | Farber et al. |
| 2006/0097613 | A1 | 5/2006 | Lee et al. |
| 2007/0075199 | A1 | 4/2007 | Stewart et al. |
| 2009/0188877 | A1 | 7/2009 | Stewart |
| 2010/0052491 | A1 | 3/2010 | Vardon |
| 2010/0181884 | A1 | 7/2010 | De La Garza et al. |
| 2011/0115356 | A1 | 5/2011 | Nash et al. |
| 2011/0186248 | A1 | 8/2011 | Lefevre et al. |
| 2012/0104924 | A1 | 5/2012 | Nash et al. |

SHELF ASSEMBLY

CROSS-REFERENCE TO RELATED APPLICATIONS

This application is a divisional application of application Ser. No. 14/577,233, filed, Dec. 19, 2014, the entire disclosure of which are hereby incorporated herein by reference.

FIELD OF THE INVENTION

The present application relates generally to a shelf assembly, and more particularly, to a shelf assembly for an appliance.

BACKGROUND OF THE INVENTION

Appliances, such as refrigerators, are known to include a plurality of shelves for storing various items. Conventional shelves are beneficial to accommodate stored items such as large pizza boxes, wine bottles and/or other food or beverage containers.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a shelf assembly for an appliance comprises a shelf panel comprising a generally planar support surface defined by a front edge, opposed side edges, and a rear edge. A frame is adapted to be mounted within an appliance to support the shelf panel with the support surface extending generally along a horizontal plane. The frame comprises a front member with a front support channel, opposed side members each with a side support channel, and a rear member. The front support channel is sized to receive and support the front edge of the shelf panel and the side support channels are each sized to receive and support one of the opposed side edges of the shelf panel. A rear support channel is formed with and extending below the rear member. The rear support channel is adapted to removably receive and capture the rear edge of the shelf panel to support the shelf panel against the force of gravity and to thereby inhibit removal of the shelf panel from the frame in the direction of the horizontal plane. The shelf panel is selectively insertable or removable from the rear support channel by temporarily deflecting the rear member upwards relative to the horizontal plane a sufficient amount to separate the rear edge of the shelf panel from the rear support channel.

In accordance with another aspect, a method of assembling a shelf assembly for an appliance is provided. The method comprises the step of sliding opposed side edges of a shelf panel, which comprises a generally planar support surface, along side support channels of a frame that is adapted to be mounted within an appliance so that the support surface extends generally along a horizontal plane. The method further comprises the step of continuing to slide the shelf panel along the side support channels until a front edge of the shelf panel is received within a front support channel of the frame. The method further comprises the step of temporarily rotating a rear member of the frame to an angle relative to the horizontal plane a sufficient amount to separate a rear support channel of the rear member from a rear edge of the shelf panel. The method further comprises the step of subsequently inserting and capturing the rear edge of the shelf panel into the rear support channel so that the rear edge of the shelf panel is supported against the force of gravity and all of the front support channel, side support channels, and rear support channel are substantially coplanar with the horizontal plane.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
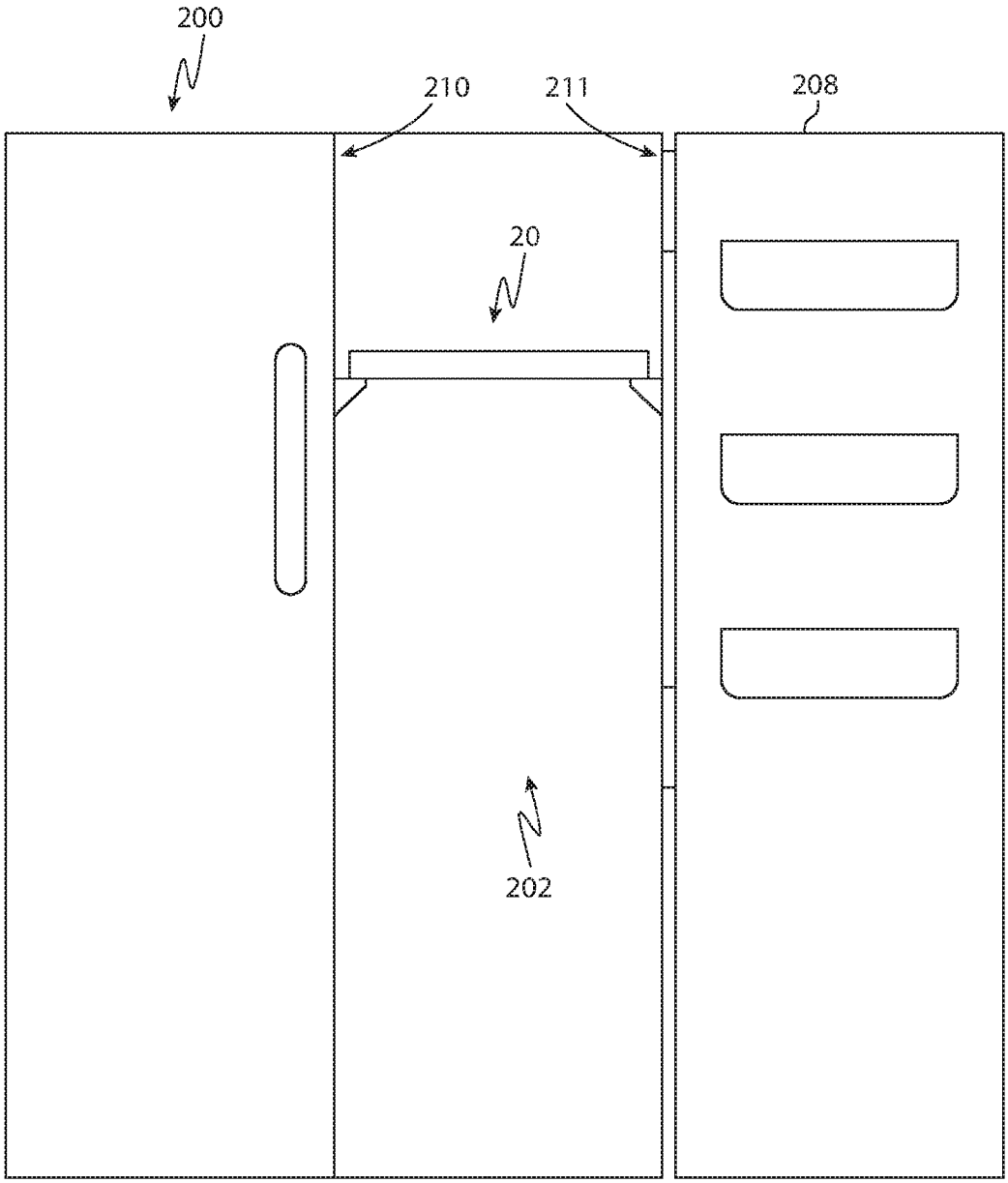
FIG. 1 is a schematic view of a refrigerator including an example shelf assembly.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Conventional glass shelves for refrigerators typically include a plastic frame that is either over-molded/encapsulated onto the glass panel, or adhered to the glass panel using a non-removable adhesive. Both of these increase cost and complexity.

The shelf frame of the instant application is designed to removably retain the glass panel in a snap-fit manner. The frame includes an internal support channel that supports the glass panel around all four sides of its outer perimeter. The shelf frame is preferably manufactured of an injection-molded plastic that is generally rigid, although the rear edge can be temporarily bent upwards to a sufficient degree to enable the glass panel to be slid into the internal support channel.

Turning to the shown example of FIG. 1, a shelf assembly 20 is described that can be used in different types of appliances, such as refrigeration appliances, freezers, dishwashers, ovens, or even other appliance types. For instance, the shelf assembly 20 can be used in storage systems for refrigeration appliances such as refrigerator/freezer units, standalone refrigerators, standalone freezers, or the like. Although the example refrigerator is illustrated as a side-by-side type refrigerator, the instant shelf assembly 20 could similarly be used in a top-mount refrigerator, bottom-mount refrigerator, French-door refrigerator, or even other types of refrigerators or freezers. FIG. 1 depicts a schematic view of a refrigerator 200 including a schematic depiction of a shelf assembly 20 in accordance with aspects of the present application. In one example, the refrigerator 200 can include a cabinet with an interior liner having at a pair of opposing interior side walls 210, 211 defining an interior area 202. A refrigerator door 208 can be opened to provide access to one or more shelf assemblies 20.

Figure 10:
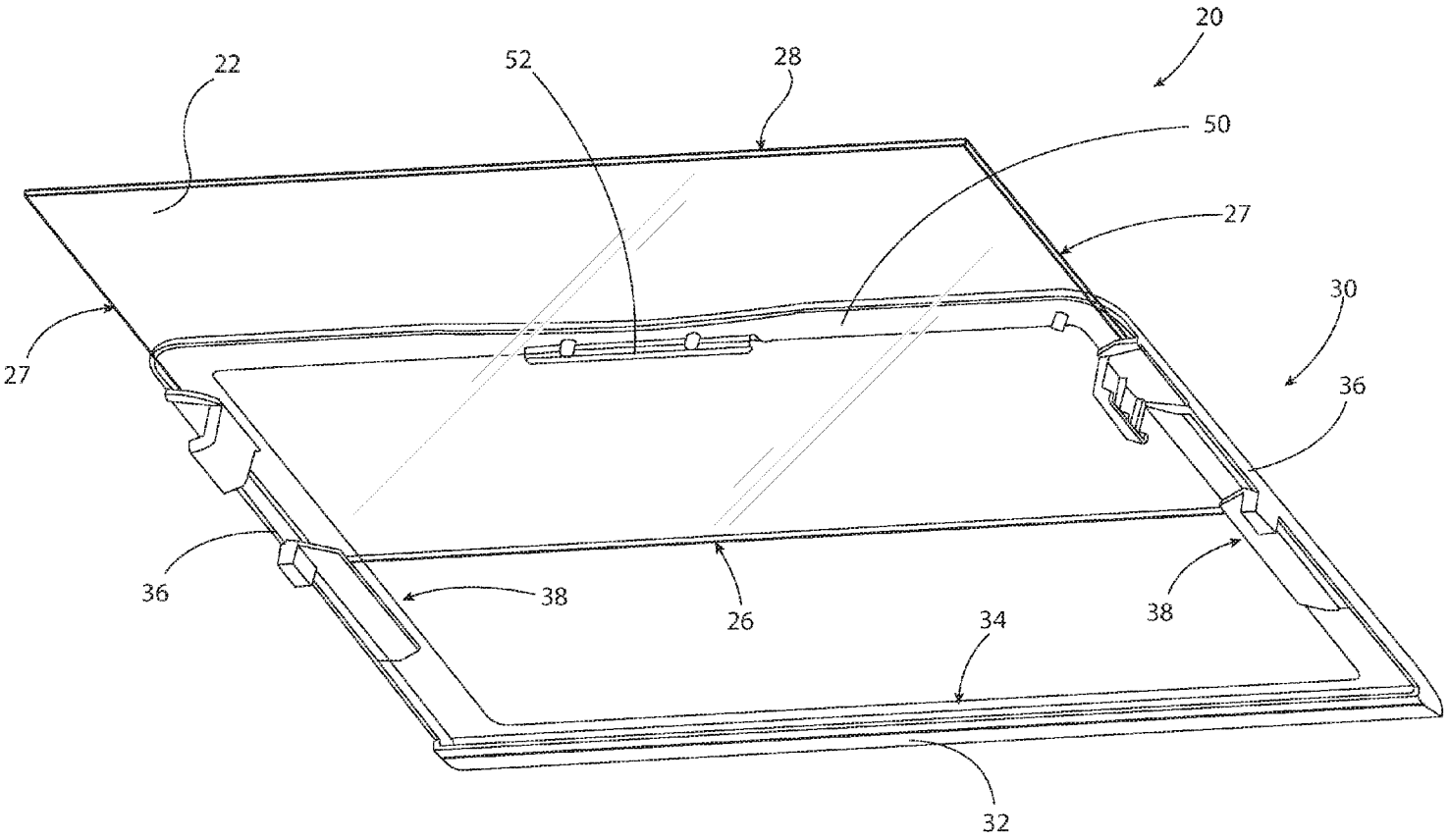
FIG. 10 is a rear perspective view illustrating the shelf panel being inserted into the frame.

Moreover, it is contemplated that the shelf assembly 20 can include at least one attachment member configured to be attached with respect to the interior side walls 210, 211 of the cabinet 209 to support the shelf within the interior area 202 of the cabinet. In one example, one or more of the attachment members can include an interlocking device configured to be attached with respect to shelf supports formed into the liner of the interior side walls 210, 211 at a selected elevation with the attachment members. On example is illustrated in FIG. 10. Other types of interlocking devices can be used, such as a projection from a rear wall that can lockingly engage corresponding structure on the shelf assembly 20.

Alternatively, it is contemplated that the attachment members could act as a cantilever support for the shelf. Although not shown, a plurality of adjustment rails, sometimes referred to as a "ladder track", could be provided with vertically disposed apertures to allow interaction with the interlocking device to maintain the shelf assembly 20 at the desired elevation within the interior area 202 of the cabinet 209. Although the Figures illustrate the sidewalls 210, 211, it is understood that the shelf assembly 20 could instead be coupled to rails on a rear wall of the cabinet. In any event, it is preferred that the shelf assembly 20 is removable from the interior area 202 of the appliance for cleaning, replacement, etc.

Figure 2:
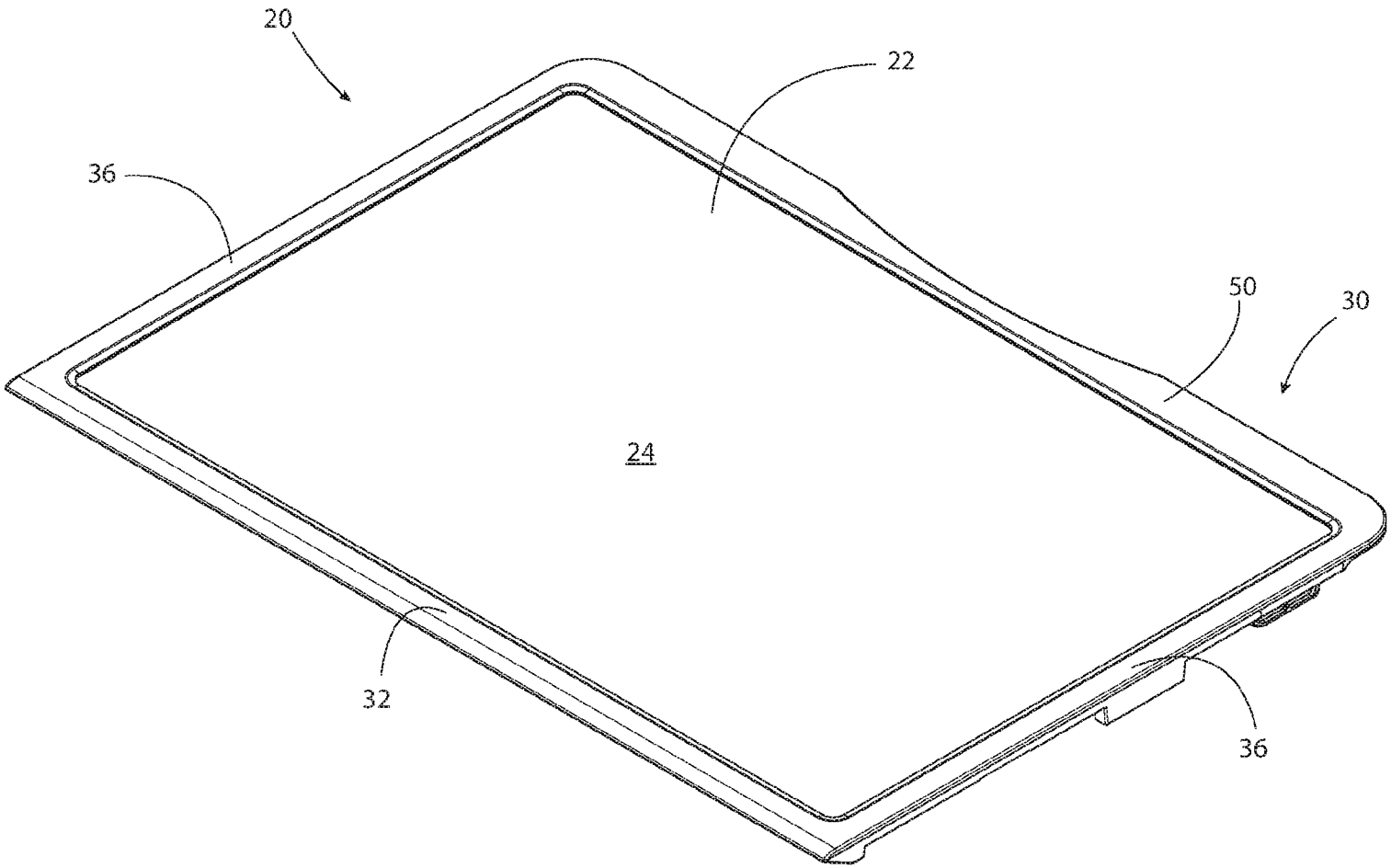
FIG. 2 is a perspective view of an example shelf assembly.
Figure 3:
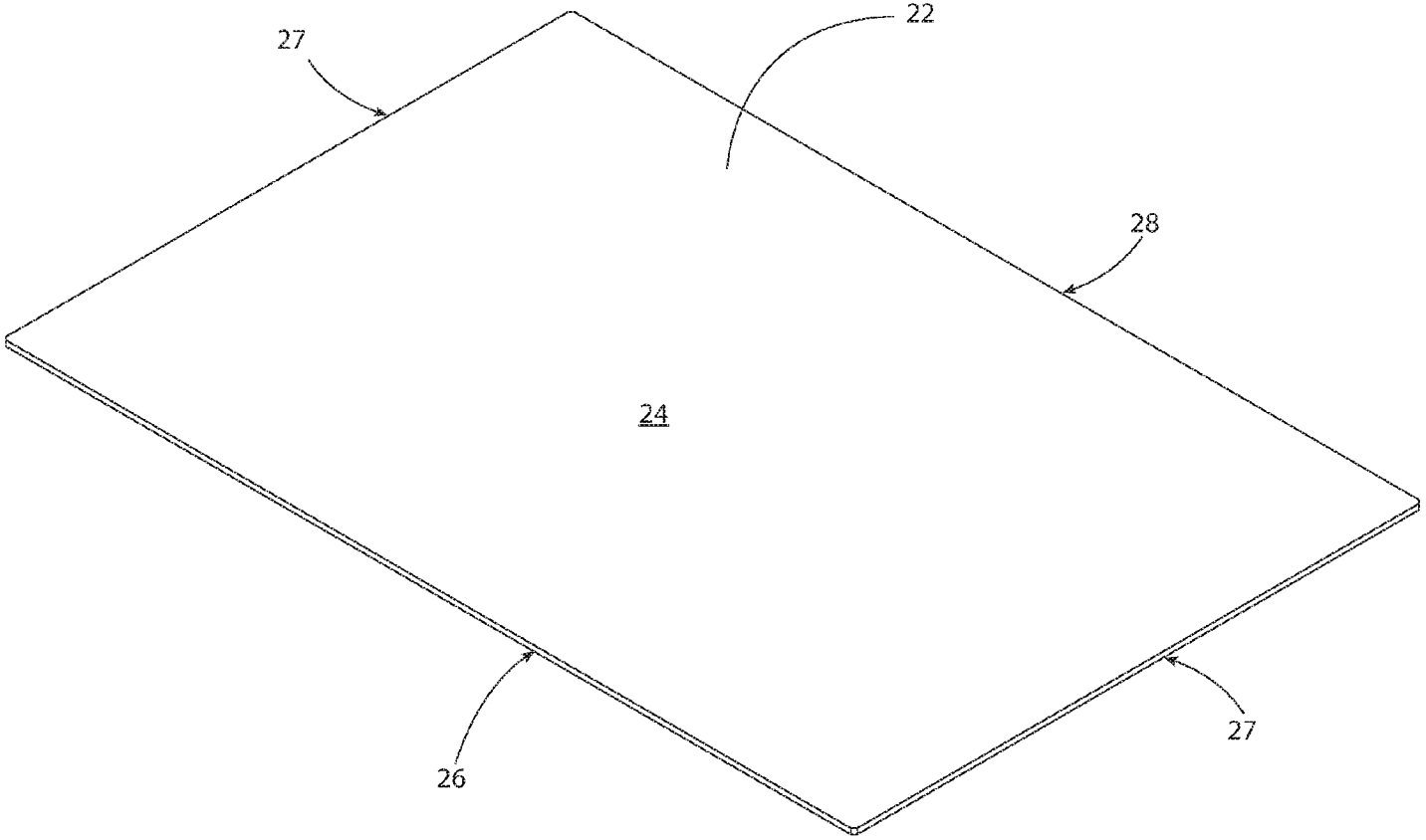
FIG. 3 is a perspective view of an example shelf panel.
Figure 4:
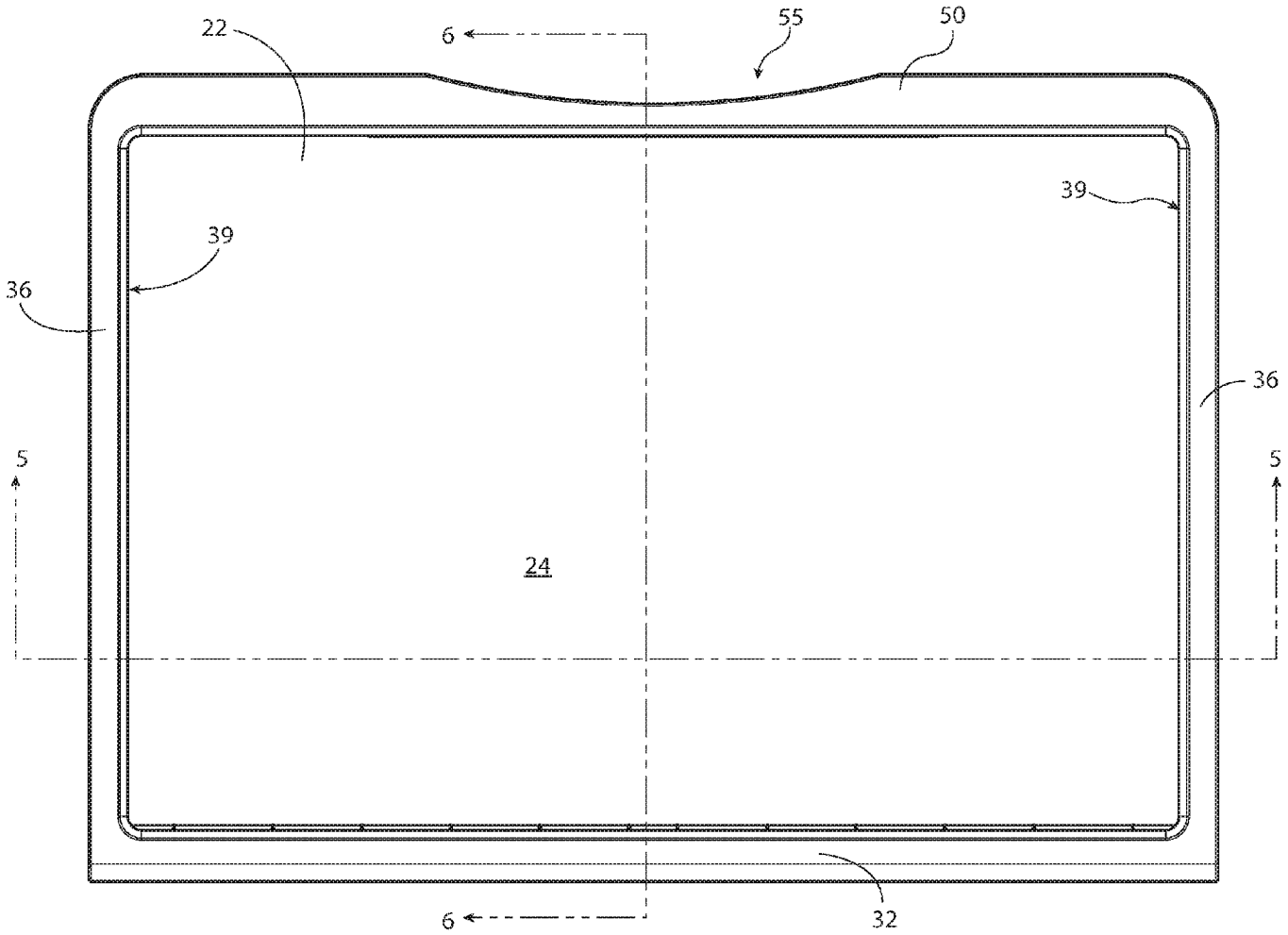
FIG. 4 is a top view of an example frame.

Turning now to FIGS. 2-4, the shelf assembly 20 includes a shelf panel 22 with a generally planar support surface 24 that is supported by a frame 30. The generally planar support surface 24 is defined by a front edge 26, opposed side edges 27, and a rear edge 28. The shelf panel 22 can have various shapes and dimensions with the generally planar support surface 24 configured to support various objects for storage within an interior of the appliance. The shelf panel 22 can have a generally square or rectangular geometry, although other shapes are contemplated. In other examples, the shelf panel 22 can be formed of various generally rigid materials, such as glass, plastic, metal, wire, or other suitable material. Preferably, the shelf panel 22 comprises a generally translucent or transparent material, such as a tempered or toughened glass or polymer panel suitable for use in a refrigerator environment. Additionally, the shelf panel 22 may have a generally constant thickness therethrough.

Figure 5:
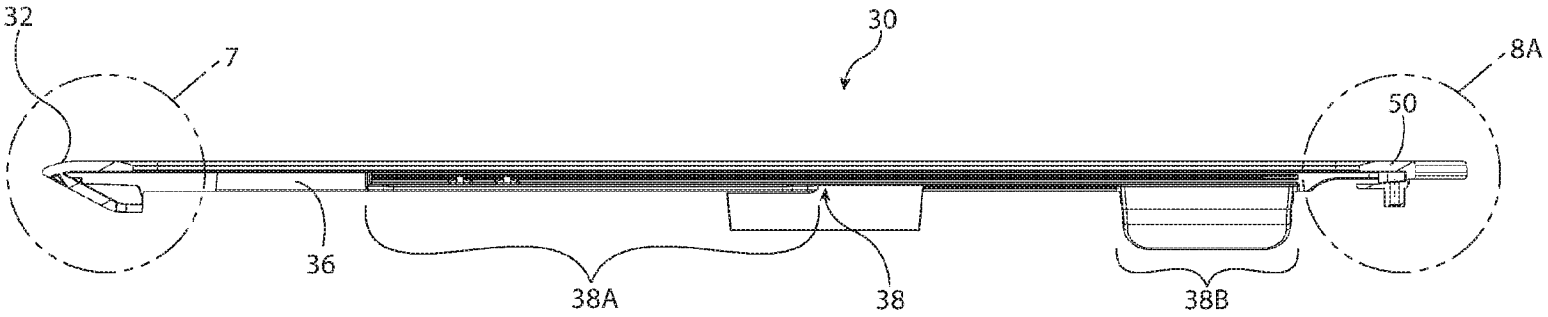
FIG. 5 is a sectional view taken along line 5-5 of FIG. 4.
Figure 6:
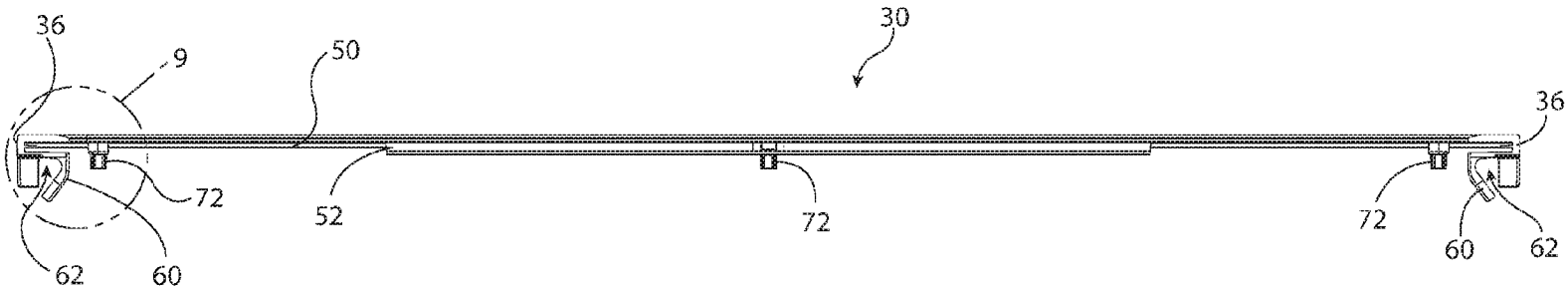
FIG. 6 is a sectional view taken along line 6-6 of FIG. 4.

The shelf assembly 20 further includes the frame 30 configured to be mounted to the interior of the refrigerator 200 to support the shelf panel 22 with the support surface 24 extending generally along a horizontal plane. Of course, the frame 30 could also be configured to support the shelf panel 22 in various other orientations. Turning to FIGS. 4-6, the frame 30 includes a front member 32 with a front support channel 34, opposed side members 36 each with a side support channel 38, and a rear member 50. These sides of the frame together generally bound a central opening that extends through the frame 30, and which is covered by the shelf panel 22. Each of the elongated front member 34 and rear member 50 extend laterally between the pair of side members 36 and are configured to support the shelf panel 22 along the horizontal plane. The front support channel 34 and the side support channels together form an internal support channel that supports the glass panel around three sides of its outer perimeter.

The frame 30 can be formed of a generally rigid material, such as metal, plastic, or the like. In one example, the frame 30 can be formed of an injection molded plastic, and may be formed as a monolithic unit. For example, the front member 34, side members 36, and rear member 50 can be integrally formed as a monolithic body to define the frame 30. At least the rear member of the frame is designed to be elastically deformable. Still, the frame 30 can be assembled from various elements and assembled as a unitary body. For example, some or all of the front, side, and rear members can be removably or non-removably attached to each other to define the frame 30. Additionally, the frame 30 may include additional features, such as raised or angled edges extending along the outer perimeter (e.g., front, rear, and/or side edges) to retain spills on the support surface 24 to provide a "spill proof" shelf. For example, some or all of the front member 32, opposed side members 36, and rear member 50 of the frame 30 can define an upper peripheral rim 39 which is raised a distance above the shelf panel 22.

Figure 7:
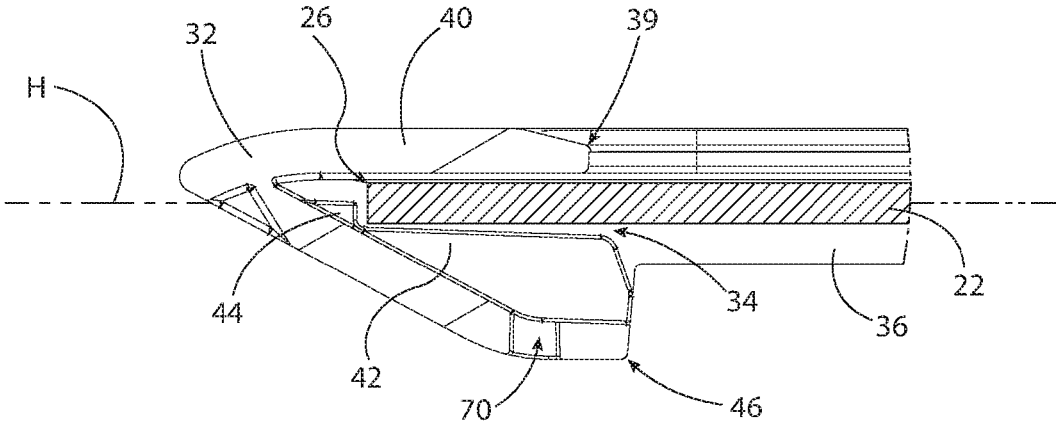
FIG. 7 is a detail view of FIG. 5 illustrating a front support channel.

Turning to FIG. 7, the frame 30 further includes the front support channel 34 extending at least partially along the front member 32 to removably receive and support the front edge 26 of the shelf panel 22 along the direction of the horizontal plane H (see FIG. 5). Preferably, the front support channel 34 is a generally contiguous channel extending along the entire front edge 26 of the shelf panel 22. Still, it is contemplated that the front support channel 34 may be discontinuous and/or extend along less than the entire front edge 26 of the shelf panel 22, such as about 90% or less, about 80% or less, about 70% or less, about 60% or less, or even about 50% or less. The front support channel 34 can provide a "C"-shaped channel that is defined between an upper wall 40 and a lower, depending wall 42, both of which may be integrally formed together with the frame 30 or may be provided as a separate element. The front member 36 may have a pointed, tapered design along the outer exterior edge, which may impact the geometry of the front support channel 34. In order to provide alignment of the shelf panel 22 within the frame 30, the front support channel 34 can include a front stop 44 to abut the front edge 26 of the shelf panel 22. In addition or alternatively, a handle 46 can be removably or non-removably fixed along at least a portion of the front member 36 to facilitate user manipulation of the shelf assembly 20.

Figure 9:
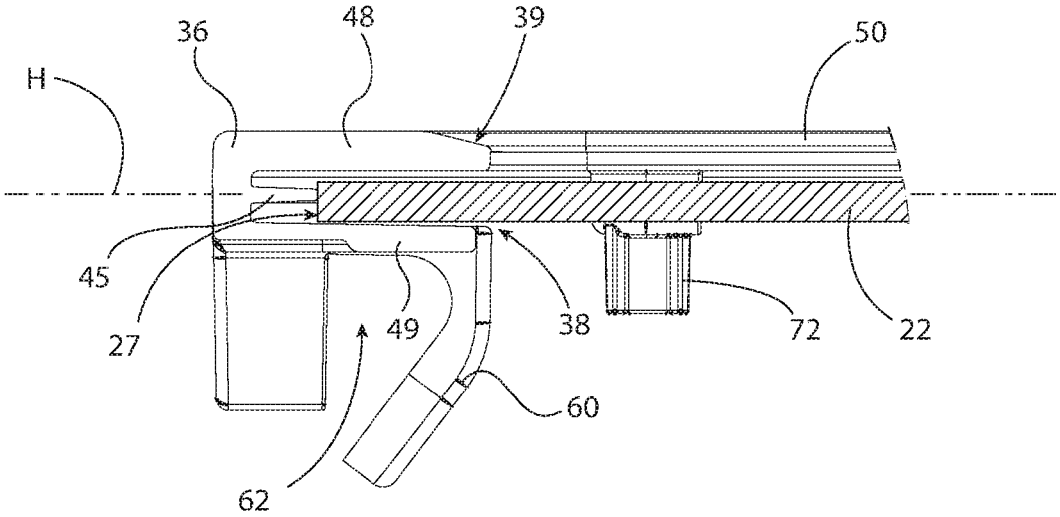
FIG. 9 is a detail view of FIG. 6 illustrating a side support channel.

Similarly, turning briefly to FIG. 9, the side support channels 38 are each sized to receive and support one of the opposed side edges 27 of the shelf panel 22. The side support channels 38 extend at least partially along the length of the associated side member 36. In one example, the side support channels 38 can extend along substantially the entire length of the associated side members 36. In another example, as shown, the side support channels 38 extend along less than an entire length of the associated side members 36, such as about 90% or less, about 80% or less, about 70% or less, about 60% or less, or about 50% or less, about 40% or less, about 30% or less, or even about 20% or less. The side support channels 38 may even comprise a plurality of discontinuous support channels 38A, 38B (see FIG. 5). The plurality of support channels 38A, 38B are both co-planar with the horizontal plane H, so that together they can receive and support the associated side edge 27. However, the plurality of support channels 38A, 38B are also shown as discontinuous along the direction of the horizontal plane H. The side support channels 38 can provide a "C"-shaped channel that is defined between an upper wall 48 and a lower, depending wall 49, which both may be integrally formed together with the frame 30 or may be provided as a separate element. Preferably, the outermost dimension of one side support channel 38 with respect to the other side support channel 38 is substantially the same or even slightly larger than the width of the shelf panel 22 between the side edges 27 so that the shelf panel 22 experiences a tight lateral fit within the frame 30. In order to provide alignment of the shelf panel 22 within the frame 30, either or both of the side support channels 38 can include a side stop 45 to abut the side edge 27 of the shelf panel 22. Still, it is understood that the fit should permit a sliding of the shelf panel 22 along the side support channels 38 during insertion or removal of the shelf panel 22 from the frame 30. Indeed, the use of two or more discontinuous support channels 38A, 38B may provide the benefit of reduced friction against the shelf panel 22 during a sliding insertion or removal, as well as reduced material usage. Finally, although only one side support channel 38 is discussed in detail, it is understood that the opposing side support channel can have identical, similar, or even different structure.

Figure 8A:
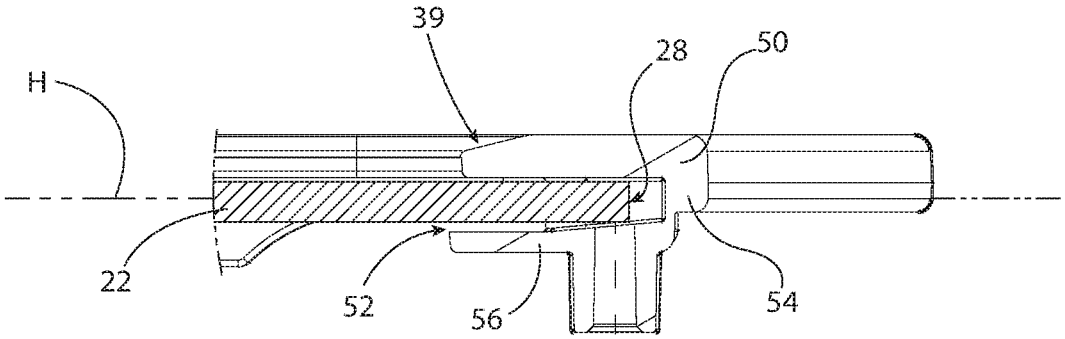
FIG. 8A is a detail view of FIG. 5 illustrating a rear support channel.

Turning now to FIG. 8A, the frame 30 further includes the rear support channel 52 formed with and extending below the rear member 50. The rear support channel 52 is adapted to removably receive and capture the rear edge 28 of the shelf panel 22 to support the shelf panel 22 against the force of gravity and to thereby inhibit removal of the shelf panel 22 from the frame in the direction of the horizontal plane H. The rear support channel 52 extends at least partially along the length of the rear member 50. As shown, the rear support channel 52 extends along less than an entire length of the rear member 50, such as about 90% or less, about 80% or less, about 70% or less, about 60% or less, or about 50% or less, about 40% or less, about 30% or less, or even about 20% or less. Preferably, the rear support channel 52 extends along less than about 50% of the entire length of the rear member 50. More preferably, the rear support channel 52 is positioned at the approximate center of the rear member 50. Still, in other examples, the rear support channel 52 could extend along substantially the entire length of the rear member 50, or could even comprise a plurality of discontinuous support channels (not shown).

The rear support channel 52 includes a first wall 54 extending downwards from the rear member 50 along a direction substantially perpendicular to the horizontal plane H (i.e., a vertical wall), and the second wall 56 projecting outwards from the first wall 54 along a direction substantially parallel to the horizontal plane H (i.e., a horizontal wall). Both of the first and second walls 54, 56 may be integrally formed together with the frame 30 or may be provided as a separate elements. Thus, the rear support channel 52 is defined between at least an underside of the rear member 50 and the second wall 56, and may be further defined by the first wall 54. A distance between the underside of the rear member 50 and the second wall 56 is substantially equal to a thickness of the rear edge 28 of the shelf panel 22 to thereby provide a relatively tight fit within the rear support channel 52. As a result, the rear support channel 52 comprises a cross-sectional area substantially corresponding to the rear edge 28 of the shelf panel 22. The combination of the underside of the rear member 50, the first wall 54 and the second wall 56 can define a "C"-shaped channel. Thus, when the shelf panel 22 is received within the rear support channel 52, the vertical first wall 54 inhibits removal of the shelf panel 22 from the frame in the direction of the horizontal plane H, and the horizontal second wall 56 supports the shelf panel 22 against the force of gravity. Thus, when the support surface 24 is loaded via food or the like, the first and second walls 54, 56 of the rear support channel 52 to inhibit the shelf panel 22 from falling or tilting due to the loading.

In order to provide alignment of the shelf panel 22 within the frame 30, the rear support channel 52 can include a rear stop (not shown) to abut the rear edge 28 of the shelf panel 22. In addition or alternatively, the rear support channel 52 could include a tapered interior geometry that narrows, between the underside of the rear member 50 and the second wall 56, to a thickness less than that of the rear edge 28 of the shelf panel 22 to provide an interference fit. Preferably, the outermost dimension of front support channel 34 with respect to the rear support channel 52 is substantially the same or even slightly larger than the length of the shelf panel 22 between the front edge 26 and rear edge 28 so that the shelf panel 22 experiences a tight longitudinal fit within the frame 30.

In the assembled state of the shelf assembly 20, suitable for supporting food or the like within the refrigerator, the rear support channel 52 is aligned to be substantially co-planar with the horizontal plane H. In one example, all of the front support channel 34, side support channels 38, and rear support channel 52 form the internal support channel and are substantially co-planar with the horizontal plane H so that the shelf panel 22, when fully inserted into the frame 30, will be maintained in a flat and level arrangement along the direction of the horizontal plane H to support items within the refrigerator.

Figure 11:
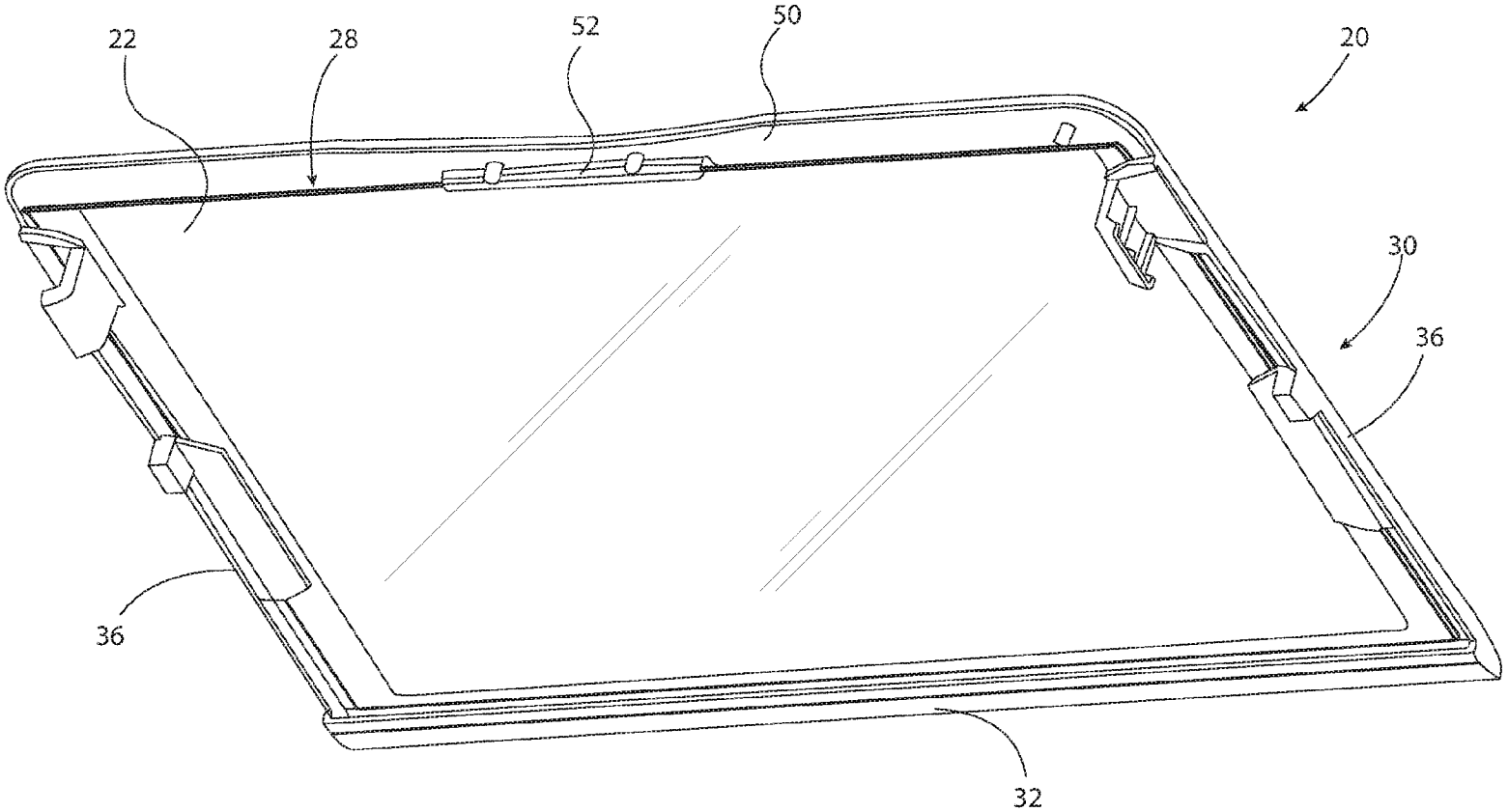
FIG. 11 is similar to FIG. 10, but shows the shelf panel fully inserted into the frame.

Turning now to FIGS. 10-11, an example assembly or disassembly of the shelf assembly 20 will be described. Starting from the rear underside of the frame 30, the side edges 27 of the shelf panel 22 are inserted into both of the side support channels 38 of the opposed side members 36. The shelf panel 22 is then pushed forward towards the front member 32 until the front edge 26 of the shelf panel 22 is seated within the front support channel 34. The front edge 26 may contact a front stop 44, if present. Finally, the rear edge 28 of the shelf panel 22 is inserted into or removed from the rear support channel 52 of the rear member 50. However, because the rear support channel 52 is aligned to be substantially co-planar with the horizontal plane H, the rear support channel 52 is first displaced out of the way prior to receiving or releasing the rear edge 28 of the shelf panel. In one example, the shelf panel is selectively insertable or removable from the rear support channel 52 by temporarily deflecting the rear member 50 upwards relative to the horizontal plane H a sufficient amount to separate the rear edge 28 of the shelf panel 22 from the rear support channel 52. That is, the rear support channel 52 can be temporarily deflected upwards, in an elastic manner, so that the rear support channel 52 is moved out of the horizontal plane H, and is temporarily positioned above the horizontal plane.

Figure 8B:
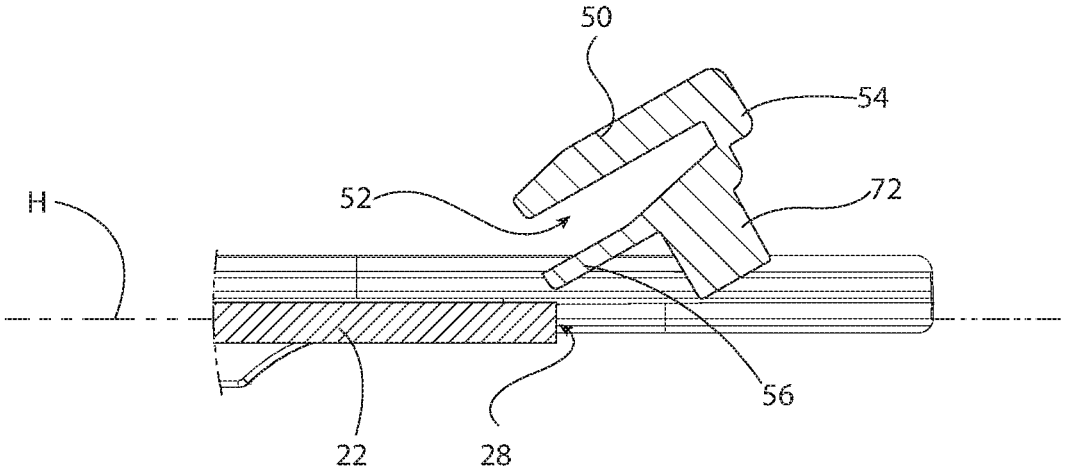
FIG. 8B is similar to FIG. 8A, but shows the rear support channel in a temporary position.

Thereafter, the rear member 50 can be manipulated into place so as to capture and retain the rear edge 28 of the shelf panel 22 within the rear support channel 52. In another example, the shelf panel 22 is selectively insertable or removable from the rear support channel 52 by temporarily translating the rear member 50 upwards a distance (i.e., above the horizontal plane H) while simultaneously rotating the rear member 50 to an angle relative to the horizontal plane H (see FIG. 8B). The act of rotating the rear member 50 further moves the rear support channel 52 outwards away from the rear edge 28 of the shelf panel 22 to thereby permit the rear support channel 52 to be manipulated into a position to receive and retain the rear edge 28 of the shelf panel 22. Moreover, the act of rotating the rear member 50 outwards to an angle relative to the horizontal plane will separate and release the horizontal second wall 56 of the rear support channel 52 from underneath the rear edge 28 of the shelf panel 22, which then permits the rear member 50 to translate further upwards.

In order to facilitate the assembly or disassembly of the shelf panel 22, only a portion of the rear member 50 containing the rear support channel 52 is typically deflected upwards to selectively insert or remove the shelf panel 22 from the frame 30. The rear member 50 of the frame 30 is defined between first and second ends interconnected with the opposed side members 36 of the frame 30. The rear member 50 may be formed, at its first and second ends, together with the opposed side members 36 as a monolithic piece. The rear support channel 52 is typically centrally located along the rear member 50, and spaced apart from the first and second ends of the rear member 50. Thus, typically only the central portion of the rear member 50 is translated upwards (and/or rotated at an angle) to insert or remove the rear edge 28 of the shelf panel 22 relative to the rear support channel 52. The first and second ends of the rear member 50, as well as the opposed side members 36, typically do not move, translate, or rotate to any appreciable degree. Further, the rear member 50 may have a cutout section 55 (see FIG. 4) that can reduce the amount of material to be translated and/or rotated to thereby reduce the resistance of the material to be manipulated.

Disassembly of the shelf panel 22 from the frame 30 occurs in reverse. First the portion of the rear member 50 containing the rear support channel 52 is translated upwards while being simultaneously rotated outwards to release the rear edge 28 out of the rear support member 52. Thereafter, the shelf panel 22 is pulled backwards to be removed from the front support channel 34 and is slid along the side support channels 38. The shelf panel 22 continues to be slidably removed from the frame until it is completely free of the side support channels 38 and separated from the frame. The rear member 50 is released and then it elastically and resiliently returns to its nominal position with the rear support channel 52 in alignment with the horizontal plane H.

In summary, the internal support channel, including the front, side and rear support channels 34, 38, 52, can facilitate retention of the shelf panel 22 on the frame 30 without the use of an adhesive, mechanical fasteners, or the like. In other words, when the rear edge 28 of the shelf panel 22 is received and captured within the rear support channel 52, the shelf panel 22 cannot be removed from the frame 30 along the direction of the horizontal plane H without further manipulation of the shelf panel 22.

Thus, during assembly or disassembly, the rear member 50 of the plastic frame 30 is bent upwards slightly while the glass panel is inserted into or removed from the internal support channel. Once the glass panel is fully inserted into the channel, the rear member 50 is released and resiliently snaps back to its original shape. The rear support channel 52 on the rear member 50 of the plastic frame is positioned to capture and retain the rear edge 28 of the glass sheet from being removed, while also providing vertical support for the glass panel. As a result, the glass panel is securely retained in place with limited movement, and can support food items across substantially the entire planar support surface 24.

Figure 12:
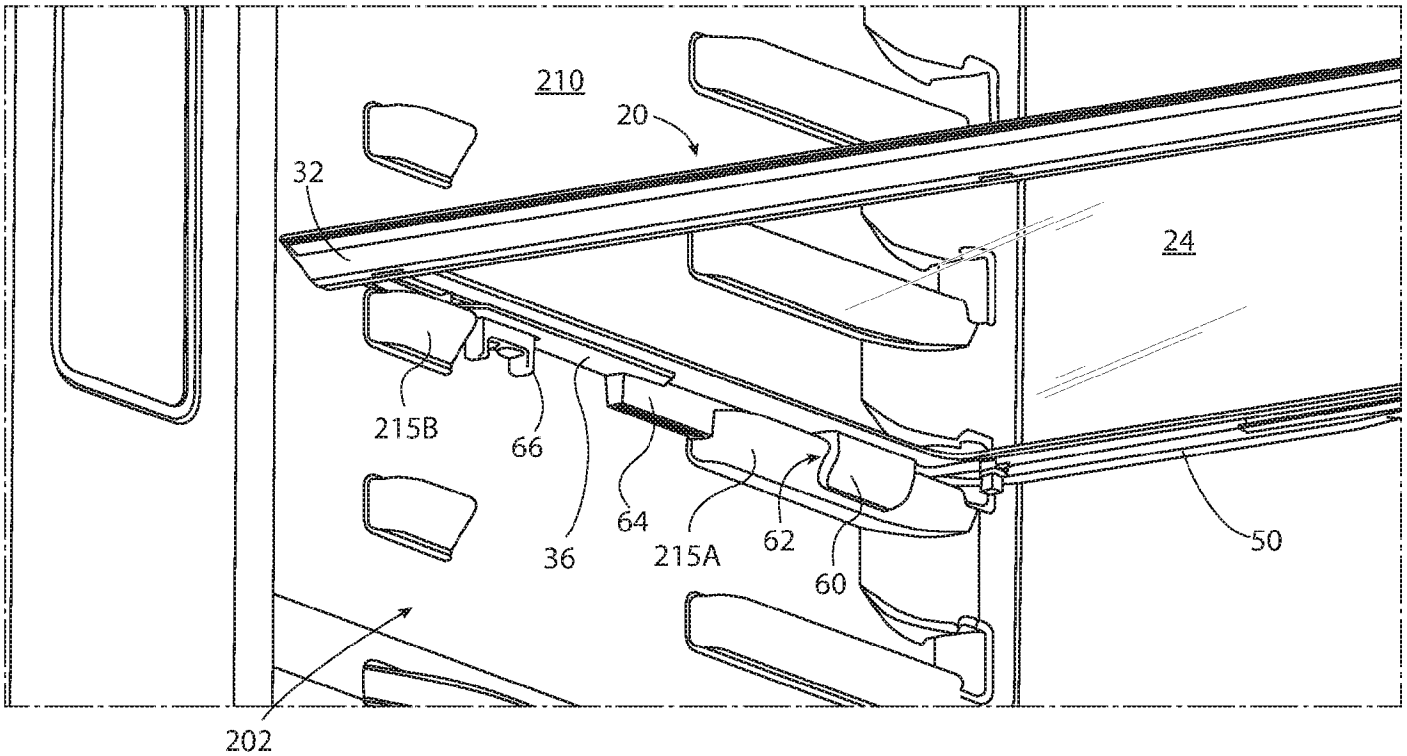
FIG. 12 shows the shelf assembly mounted within an interior of an appliance.

In addition or alternatively, turning briefly to FIGS. 9 and 12, the frame 30 can further include a pair of hanger members 60 configured to engage corresponding support structure, such as shelf supports 215A, 215B formed into the liner sidewalls 210, 211 of an appliance for supporting the frame 30 within the refrigerator 200. In one example, the hanger members 60 can include resilient clips, latches, or the like to engage the shelf supports 215A, 215B on the interior liner of the appliance. The hanger members 60 could further include an opening or aperture 62 sized to receive the shelf supports 215A, 215B of the liner, such as side rails that project inwardly from the side walls (or even the rear wall) of the interior liner. The aperture 62 can have an interior geometry that corresponds to that of the side rails, such as an angled geometry that provides a self-alignment feature laterally across the width of the appliance. Although only a single sidewall of the appliance is shown in FIG. 12, it is understood that similar structure can be located on the opposite sidewall.

In the shown example of FIG. 12, the aperture 62 of the hanger member 60 can slidingly receive the rear shelf support 215A, while the associated side member 36 of the frame 30 rests upon the upper surface of the rear shelf support 215A. During assembly into the appliance, the frame 30 can be slid backwards along the rear shelf support 215A until an alignment stop 64 of the frame 30 contacts the rear shelf support 215A to thereby limit rearward insertion. Then, during use, the user can slidably move the shelf assembly 20 forwards and backwards along the upper surface of the rear shelf support 215A. In another example, a second alignment stop 66 can be used to inhibit sliding action of the shelf assembly 20, so that the shelf remains in a fixed position. The second alignment stop 66 can be located rearward of a front shelf support 215B to thereby inhibit the shelf frame 30 from being slidably moved forwards. In this configuration, the alignment stops 64, 66 are thereby placed between the front and rear shelf supports 215A, 215B so that the shelf assembly 20 cannot be slidably moved forward, unless the front member 32 of the frame 30 is lifted vertically so that the second alignment stop 66 is raised clear of the front shelf support 215B. It is contemplated that either or both of the alignment stops 64, 66 could be formed together with the frame 30 as a monolithic element, or could be removably or non-removably attached to the frame 30 so as to be an optional feature. It is further contemplated that only a single shelf support could be used, or even more than two shelf supports.

Additionally, one or more auxiliary support members (not shown) can be provided that can project outwardly (or inwardly) for engagement with other apertures (or projections) of the appliance. The auxiliary support members may provide additional vertical support and/or may be used to align the frame 30 relative to the cabinet and inhibit twisting of the frame 30. In other examples, the hanger members 60 can include hooks (not shown) that are configured to engage vertically disposed apertures of the adjustment rails to maintain the shelf assembly 20 at the desired elevation within the interior area 202 of the cabinet 209. To remove the frame 30 from the cabinet 209, a user simply raises the shelf assembly 20 vertically upwards to disengage the hanger members 60 from the apertures. Depending upon the attachment mechanism, each hanger member 60 can be provided on the side or at the rear of the frame 30.

In addition or alternatively, the frame 30 can further include lower support channels (not shown) for supporting drawers or other depending structure. For example, the frame 30 could include two pairs of lower support channels to for two or more independent deli drawers in a side-by-side arrangement. In an alternative arrangement, a single center lower support channel could provide a double support for each of the two side-by-side drawers. In one example, the lower support channels could be designed as a sliding support track with a built-in roller wheel and a drawer anti-removal stops at the front end of the support track. The built-in roller wheels rotate against a corresponding track molded into the deli drawer. Similarly, the sliding deli drawer includes a pair of roller wheels at a rear end of the drawer that roll along the sliding support track of the support channels. Thus, the deli drawer is supported by four total roller wheels. Each of the lower support channels can be snap-fit into a slot 70 at the front edge of the frame. Each of the lower support channels is further supported by either a snap-fit connection at the rear member 50 of the frame 30, or via a mechanical faster that is secured into a boss 72 at the rear member 50 of the frame 30. However, it is contemplated that some or all of the lower support channels could also be integrally molded to the underside of the shelf frame.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A shelf assembly for an appliance, comprising:

a shelf panel comprising a generally planar support surface defined by a front edge, opposed side edges, and a rear edge;

a frame adapted to be mounted within an appliance to support the shelf panel with the support surface extending generally along a horizontal plane, the frame comprising a rigid front member with a front support channel, rigid opposed side members each with a side support channel, and a flexible rear member that has a length defined between first and second ends interconnected with the opposed side members, wherein the front support channel is sized to receive and support the front edge of the shelf panel and the side support channels are each sized to receive and support one of the opposed side edges of the shelf panel, and wherein at the nominal condition of the frame, all of the front support channel, side support channels, and rear support channel are substantially co-planar along the horizontal plane; and a rear support channel formed with and extending below the rear member, the rear support channel adapted to removably receive and capture the rear edge of the shelf panel to support the shelf panel against the force of gravity and to thereby inhibit removal of the shelf panel from the frame in a direction of the horizontal plane, wherein the rear support channel comprises a first wall extending downwards from the rear member along a direction substantially perpendicular to the horizontal plane, and a second wall projecting outwards from the first wall towards the front member and along a direction substantially parallel to the horizontal plane, wherein the rear support channel is a "C"-shaped channel defined between an underside of the rear member and the second wall and is positioned about a center of the flexible rear member, and wherein the second wall extends along less than about 50% of the length of the flexible rear member so that the rear support channel thereby extends along less than about 50% of the length of the flexible rear member, and wherein the shelf panel is selectively insertable or removable from the rear support channel by temporarily deflecting the rear member upwards relative to the horizontal plane a sufficient amount to separate the rear edge of the shelf panel from the rear support channel, and thereafter elastically returning the frame to the nominal condition in which all of the front support channel, side support channels, and rear support channel are again substantially co-planar with the horizontal plane.

2. The shelf assembly of claim 1, wherein a distance between the underside of the rear member and the second wall is substantially equal to a thickness of the rear edge of the shelf panel.

3. The shelf assembly of claim 1, wherein the rear support channel comprises a cross-sectional area substantially corresponding to the rear edge of the shelf panel.

4. The shelf assembly of claim 1, wherein the front member, opposed side members, and rear member are integrally formed as a monolithic body to define the frame.

5. The shelf assembly of claim 1, wherein only a portion of the rear member containing the rear support channel is deflected upwards to selectively insert or remove the shelf panel from the frame.

6. The shelf assembly of claim 1, wherein the shelf panel is selectively insertable or removable from the rear support channel by temporarily translating the rear member upwards a distance while simultaneously rotating the rear member to an angle relative to the horizontal plane.

7. The shelf assembly of claim 1, wherein the side support channels extend along less than an entire length of the opposed side members.

8. The shelf assembly of claim 7, wherein each side support channel comprises a plurality of discontinuous support channels.

9. The shelf assembly of claim 1, wherein the front support channel is a generally contiguous channel extending along the entire front edge of the shelf panel.

10. The shelf assembly of claim 1, wherein the frame further comprises a pair of hanger members configured to engage corresponding support structure of an appliance for supporting the frame within said appliance.

11. The shelf assembly of claim 1, wherein the front member, opposed side members, and rear member of the frame define an upper peripheral rim which is raised a distance above the shelf panel.

12. The shelf assembly of claim 1, wherein the shelf panel comprises a glass panel.

13. The shelf assembly of claim 1, comprising a front stop located within the front support channel of the frame, the shelf panel being slidable along the side support channels until the front edge of the shelf panel contacts a front stop.

14. The shelf assembly of claim 13, wherein the front stop is positioned so that, at the nominal condition of the frame, the rear edge of the shelf panel is positioned immediately adjacent the first wall of the rear member.

15. The shelf assembly of claim 1, wherein the rear edge of the shelf panel is supported against the force of gravity by the rear support channel without a subjacent support structure.

16. The shelf assembly of claim 1, wherein the frame does not comprise subjacent support structure vertically below the rear support channel so that the rear edge of the shelf panel is supported against the force of gravity only by the rear support channel.

17. The shelf assembly of claim 10, wherein the pair of hanger members are disposed one each upon an underside of the opposed side members at a location adjacent to the first and second ends of the rear member to thereby further support the rear edge of the shelf panel.

18. The shelf assembly of claim 17, wherein the pair of hanger members partially define the side support channels.

* * * * *